US012310488B2

(12) United States Patent
Ko

(10) Patent No.: US 12,310,488 B2
(45) Date of Patent: May 27, 2025

(54) TACTICAL BELT

(71) Applicant: Henry Ko, Irwindale, CA (US)

(72) Inventor: Henry Ko, Irwindale, CA (US)

(73) Assignee: CONDOR OUTDOOR PRODUCTS, INC., Irwindale, CA (US)

( * ) Notice: Subject to any disclaimer, the term of this patent is extended or adjusted under 35 U.S.C. 154(b) by 218 days.

(21) Appl. No.: 18/354,125

(22) Filed: Jul. 18, 2023

(65) Prior Publication Data

US 2025/0017359 A1 Jan. 16, 2025

Related U.S. Application Data

(63) Continuation-in-part of application No. 29/879,694, filed on Jul. 11, 2023.

(51) Int. Cl.

| | |
|---|---|
| ***A45F 5/02*** | (2006.01) |
| ***A41D 27/04*** | (2006.01) |
| ***A44B 11/26*** | (2006.01) |

(52) U.S. Cl.

CPC ..... *A45F 5/021* (2013.01); *A41D 27/04* (2013.01); *A44B 11/266* (2013.01)

(58) Field of Classification Search

CPC . A45F 5/021; A45F 5/00; A45F 13/00; A44B 11/266; A44B 11/065; A44B 11/25; A41D 27/04; A41D 1/00

See application file for complete search history.

(56) References Cited

U.S. PATENT DOCUMENTS

| | | | | |
|---|---|---|---|---|
| 5,960,523 | A * | 10/1999 | Husby | B60R 21/01546 24/642 |
| 8,187,129 | B2 * | 5/2012 | Kobayashi | F16G 5/16 474/242 |
| 9,439,479 | B1 * | 9/2016 | Vu | A44B 11/2576 |
| 11,006,699 | B1 * | 5/2021 | Goodwin | A44B 11/2584 |
| 11,259,583 | B1 * | 3/2022 | Spanopoulos | F41C 33/0236 |
| 11,317,736 | B2 * | 5/2022 | Yabuuchi | A44B 11/2549 |
| 11,561,065 | B1 * | 1/2023 | Hoffman | F41C 33/046 |
| 11,807,187 | B1 * | 11/2023 | Minjeur | B60R 22/18 |
| 2004/0111846 | A1 * | 6/2004 | Itoigawa | B60R 22/48 24/633 |
| 2010/0234780 | A1 * | 9/2010 | Allen | A61F 5/028 602/1 |
| 2010/0235968 | A1 * | 9/2010 | Lee | A41F 9/002 2/338 |
| 2010/0265056 | A1 * | 10/2010 | Lai | B60R 22/48 340/457.1 |
| 2011/0068565 | A1 * | 3/2011 | Arnold | B60R 21/18 280/733 |

(Continued)

*Primary Examiner* — Brian D Nash

(74) *Attorney, Agent, or Firm* — Clement Cheng

(57) ABSTRACT

A utility belt has an inside latch body which includes an inside latch body loop. The outside latch body is configured to release and connect to the inside latch body. The outside latch body includes an outside latch body loop. The outside latch body fits over the inside latch body. The outside belt connects to the inside latch body at the inside latch body loop. The outside belt connects to the outside latch body at the outside latch body loop. A main indent is formed on the outside latch body. A connecting stud is formed on the inside latch body and is configured to insert into the main indent. A main indent magnet is mounted at the main indent. A connection stud magnet is mounted in the connecting stud.

16 Claims, 5 Drawing Sheets

(56) References Cited

U.S. PATENT DOCUMENTS

| | | | | |
|---|---|---|---|---|
| 2014/0014700 | A1* | 1/2014 | Gill | A45F 3/08 224/637 |
| 2017/0112266 | A1* | 4/2017 | Constanzo | A45F 3/14 |
| 2018/0192947 | A1* | 7/2018 | Tokko | B29C 66/1122 |
| 2019/0256041 | A1* | 8/2019 | Tinoco | G01R 33/072 |
| 2021/0025672 | A1* | 1/2021 | Shearer | F41C 33/041 |
| 2021/0204658 | A1* | 7/2021 | Jessup | A44B 11/2549 |
| 2021/0307493 | A1* | 10/2021 | Blackwell | A45F 5/021 |
| 2022/0015484 | A1* | 1/2022 | Pagano | A44B 11/263 |
| 2022/0071376 | A1* | 3/2022 | Brown | A45F 3/005 |
| 2022/0087575 | A1* | 3/2022 | Persidsky | G06F 3/0482 |
| 2022/0160065 | A1* | 5/2022 | Pagano | A45C 1/04 |
| 2023/0397697 | A1* | 12/2023 | Fleese | A41F 9/002 |
| 2024/0172844 | A1* | 5/2024 | Lavigne | A44B 11/25 |
| 2024/0415217 | A1* | 12/2024 | Barnhart | H04R 1/026 |

* cited by examiner

TACTICAL BELT

TECHNICAL FIELD

The present invention is in the field of utility tactical belts.

BACKGROUND

A wide variety of utility and tactical belts can hold tactical gear such as holsters and ammunition carriers. Utility belts are belts that have multiple pouches or pockets attached to them, which can hold items such as flashlights, knives, keys, pens, handcuffs, radios, etc. Utility belts are often used by workers, technicians, or hobbyists who need to access their tools quickly and conveniently. Utility belts are usually made of leather, nylon, or canvas, and have a buckle or a snap closure. Some utility belts have adjustable loops or straps to fit different sizes of pouches or tools. Tactical belts are belts that have a webbing or a MOLLE (Modular Lightweight Load-carrying Equipment) system attached to them, which can hold items such as firearms, magazines, grenades, medical kits, etc. Tactical belts are often used by military personnel, law enforcement officers, or security guards who need to carry their weapons and gear securely and comfortably. Tactical belts are usually made of synthetic materials such as polyester or nylon and have a hook-and-loop or a buckle closure. Some tactical belts have padding or a stiffener to provide extra support and stability.

Users of utility belts can choose the type and number of pouches or pockets they need for their tasks and attach them to the belt in any configuration they prefer. They are easy to use and access. Users can quickly reach for their tools or equipment without having to open any zippers or flaps and can easily detach or reattach the pouches or pockets as needed. They are durable and comfortable. Utility belts are made of sturdy materials that can withstand wear and tear and have a flexible design that can conform to the user's body shape.

Tactical belts are secure and reliable. Users can attach their weapons and gear to the belt using the webbing or the MOLLE system, which prevents them from falling off or shifting around during movement. Tactical belts are modular and compatible. Users can attach various accessories or attachments to the belt using the webbing or the MOLLE system, which allows them to expand their carrying capacity and functionality. Tactical belts are made of rigid materials that can support heavy loads and have a padded or a stiffened design that can distribute the weight evenly and reduce fatigue.

SUMMARY OF THE INVENTION

A combination utility and tactical belt has an inside latch body which includes an inside latch body loop. The outside latch body is configured to release and connect to the inside latch body. The outside latch body includes an outside latch body loop. The outside latch body fits over the inside latch body. The outside belt connects to the inside latch body at the inside latch body loop. The outside belt connects to the outside latch body at the outside latch body loop. A main indent is formed on the outside latch body. A connecting stud is formed on the inside latch body and is configured to insert into the main indent. A main indent magnet is mounted at the main indent. A connection stud magnet is mounted in the connecting stud.

The connection stud attracts the main indent magnet which aligns the main indent to the connecting stud and biases the connecting stud into the main indent. A main latch attracts to the connecting stud once the connecting stud inserts into the main indent. A first release latch extends into the main indent, and a second release latch extends into the main indent. The first release latch engages the connecting stud. The second release latch engages the connecting stud. The side release buttons include a first button and a second button. The first button is mounted opposite the second button. The side release buttons are configured to release the first release latch and the second release latch.

The outside latch body further includes an inside housing and an outside housing. The outside latch body has a main latch protrusion. The inside latch body has a main latch depression configured to receive the main latch protrusion. The main latch is mounted within the main latch protrusion. The connecting stud further includes a connecting stud front indent. The main latch has a main latch engagement edge. The main latch engagement edge is configured to engage the connecting stud front indent. The first button is configured to release the second release latch. The second button is configured to release the first release latch. The second button is adjacent to the second release latch. The first button is adjacent to the first release latch. The first side stud indent is formed on the connecting stud and a second side stud indent is formed on the connecting stud opposite the first side stud indent. The first release latch engages the first side stud indent. The second release latch engages the second side stud indent.

The outer belt includes further includes a substrate sandwiched between a first outer belt layer and a second outer belt layer. The substrate is thicker and stiffer than the first outer belt layer and the second outer belt layer. The first outer belt layer further includes outer belt sections. The outer belt sections have upper slots and lower slots defined between first section stitches and second section stitches. The utility belt further includes an inner belt that attaches to and removes from the outer belt. The utility belt further includes a padded belt. The padded belt attaches and removes from the outer belt. The padded belt has a belt pad formed at a belt pad wider portion. The inner belt is modularly interchangeable with the padded belt.

The following call out list of elements can be a useful guide in referencing the element numbers of the drawings.

20 Inside Latch Body
21 Main Latch Depression
22 Connecting Stud
23 Connecting Stud Front Indent
24 Second Side Stud Indent
25 First Side Stud Indent
26 Inside Latch Body Engagement Face
27 Inside Latch Body Forward Edge
28 Inside Latch Body Loop
29 Inside Latch Body Belt Retainer

30 Outside Latch Body
31 Inside Housing
32 Outside Housing
33 First Rivet
34 Second Rivet
35 Third Rivet
36 Front Rivet
37 Main Latch Protrusion
38 Outside Latch Body Loop
39 Outside Latch Body Belt Retainer
40 Main Latch
41 Main Latch Magnet
42 Main Latch Engagement Edge
43 Connecting Stud Magnet
50 Side Release Buttons
51 First Button
52 Second Button
53 First Release Latch
54 Second Release Latch
55 Main Indent
56 Main Indent Magnet
60 Outer Belt
61 First Outer Belt Layer
62 Second Outer Belt Layer
63 Outer Belt Section
64 Upper Slot
65 Lower Slot
66 First Section Stitch
67 Second Section Stitch
70 Inside Belt
71 Inside Belt Overlap
72 Inside Belt Connection Tape
80 Padded Belt
81 Belt Pad
82 Belt Pad Overlap
83 Belt Pad Wider Portion
88 Substrate
89 Outside Belt Connection Tape

DETAILED DESCRIPTION OF THE EMBODIMENTS

Figure 1:
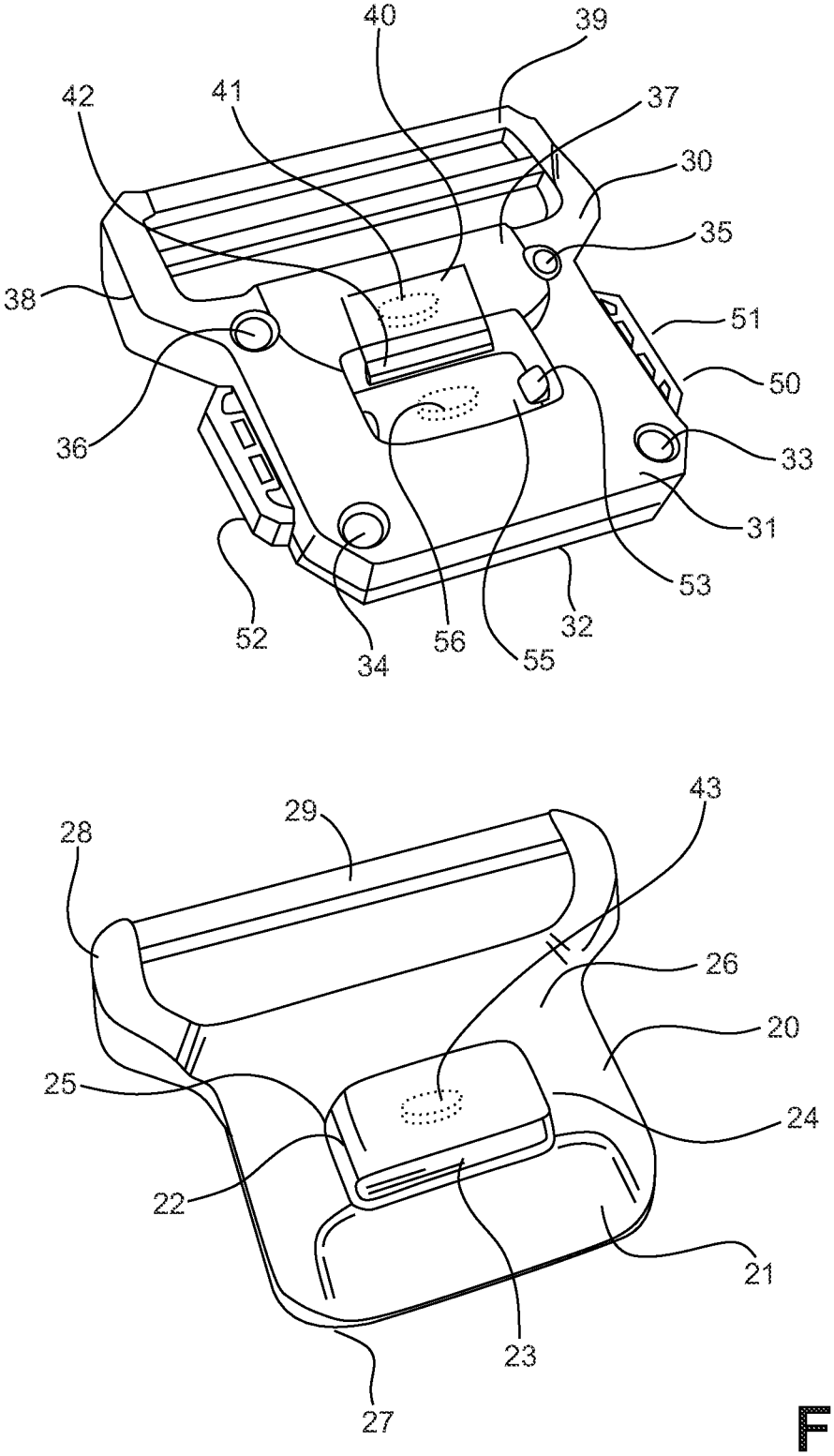
FIG. 1 is an exploded view of the present invention buckle.

As seen in FIG. 1, the outer belt has a buckle, and the buckle includes the inside latch body 20 and the outside latch body 30. The inside latch body 20 has a main latch depression 21. The main latch depression 21 receives the main latch protrusion 37. The connecting stud 22 has a connecting stud front indent 23. The connecting stud 22 of the inside latch body 20 inserts into the main indent 55. The connecting stud 22 has a first side indent 25 and a second side indent 24. The second side indent can receive the second release latch 54 and the first decide indent 25 can receive the first release latch 53. The connecting stud 22 has a connecting stud front indent 23 which receives the main latch engagement edge 42 of the main latch 40.

The outside latch body 30 has an inside housing 31 and an outside housing 32. The inside housing 31 connects to the outside housing 32 at various rivets such as a first rivet 33, a second rivet 34, a third rivet 35, and a fourth rivet 36. The rivets can be plastic sonically welded studs that extend into stud channels formed on the inside housing of the outside housing. The inside housing and outside housing form two halves of the outside latch body 30. The inside housing 31 faces the inside latch body 20 and also faces the user. The outside housing 32 faces away from the user and faces away from the inside latch body 20.

The main indent magnet 56 attracts to the connecting stud magnet 43 to draw and align the connecting stud 22 into the main indent 55. Once the connecting stud 22 enters the main indent 55, the main latch magnet 41 can attracts to the connecting stud magnet 43. Neodymium magnets can be used for the main latch magnet 41. Alternatively, the main latch magnet 41 can be replaced by a ferrous magnetically attractive member.

The main latch protrusion 37 is formed on the outside latch body 30 and houses the main latch 40. The main latch 40 slides into the main indent 55 and retracts from the main indent 55. The main latch 40 can be formed of a rectangular plastic plate which retains a main latch magnet 41.

The main latch 40 slides within a main latch cavity formed in the main latch protrusion 37. The main latch cavity is formed between the outside housing 32 and the inside housing 31. The main latch magnet 41 attracts to the connecting stud magnet 43 which biases the main latch magnet 41 toward the connecting stud magnet 43 and slides the main latch engagement edge 42 of the main latch 40 into the connecting stud front indent 23.

A first release latch 53 and a second release latch 54 respectively engage a first side stud indent 25 and a second side stud indent 24. The first release latch, second release latch and main latch engagement edge retain the connecting stud 22 of the inside latch body 20 which secures the inside latch body 22 the outside latch body 30. The side release buttons 50 can also be configured to retract the main latch 40.

To release the first release latch on the second release latch, a user simultaneously depresses side release buttons 50 which include a first button 51 adjacent to the first release latch 53 and a second button 52 adjacent to the second release latch 54. The first button 51 and the second button 52 must be depressed simultaneously to release both the first release latch 53 and the second release latch 54. For example, the first button 51 is pushed toward the second button 52, and the second button 52 is pushed toward the first button 51. Similarly, the second button 52 travels in the same direction as the first release latch 53, and the first button 51 travels in the same direction as the second release latch 54. The first button 51 can actuate the second release latch 54 and the second button 52 can actuate the first release latch 53.

The inside latch body 20 connects to the outer belt at the inside latch body belt retainer 29. The inside latch body belt retainer can be formed as an inside latch body loop 28. Similarly, the outside latch body 30 can have an outside latch body belt retainer 39 which can be formed as an outside latch body loop 38. The outer belt connecting to the inside latch body belt retainer 29 also connects to the outside latch body belt retainer 39.

Figure 2:
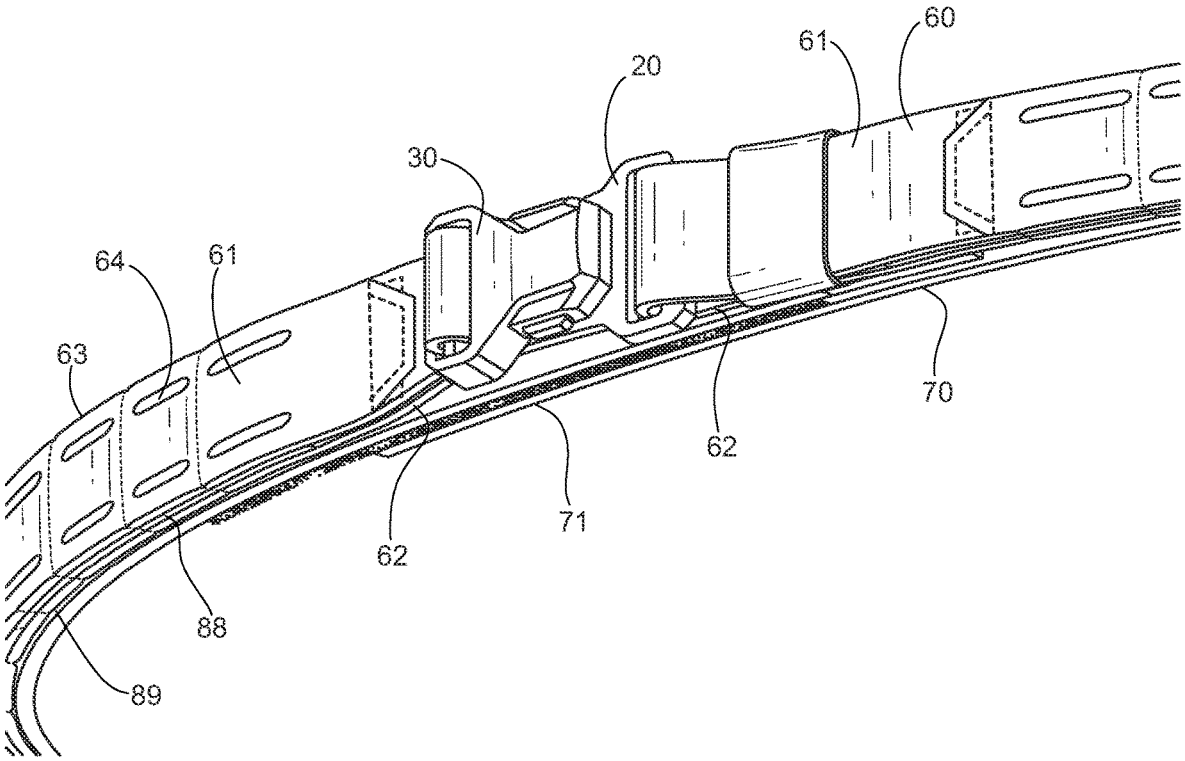
FIG. 2 is a front view of the present invention showing the buckle area.

As seen in FIG. 2, the outer belt 60 can be attached to the inner belt 70. The inner belt 70 can be worn on trousers with the outer belt attached to the inner belt over the trouser belt loops. The inside belt 70 has an inside belt overlap 71 which can be an inside belt connection tape 72 such as a hook and loop tape. The outside belt and the inside belt are also attached by an outside belt connection tape 89 forming an interface that secures the outside belt to the inside belt. The outside belt 60 has a first outer belt layer 61 and a second outer belt layer 62. The first outer belt layer 61 has a plurality of upper slots 64 and a plurality of lower slots 65 in the outer belt sections 63. Thus, a MOLLE (Modular Lightweight Load-carrying Equipment) structure can be formed on the outer belt 60 first outer belt layer 61.

Optionally, a substrate 88 can be sandwiched between the first outer belt layer 61 and the second outer belt layer 62. The substrate is preferably formed of a strip of elongated high density polyethylene that is stitched to the first outer belt layer 61 and the second outer belt layer 62 when the first outer belt layer 61 is stitched to the second outer belt layer 62. The substrate can be varied in thickness depending upon stiffness requirements and stiffness preferences for users.

Figure 3:
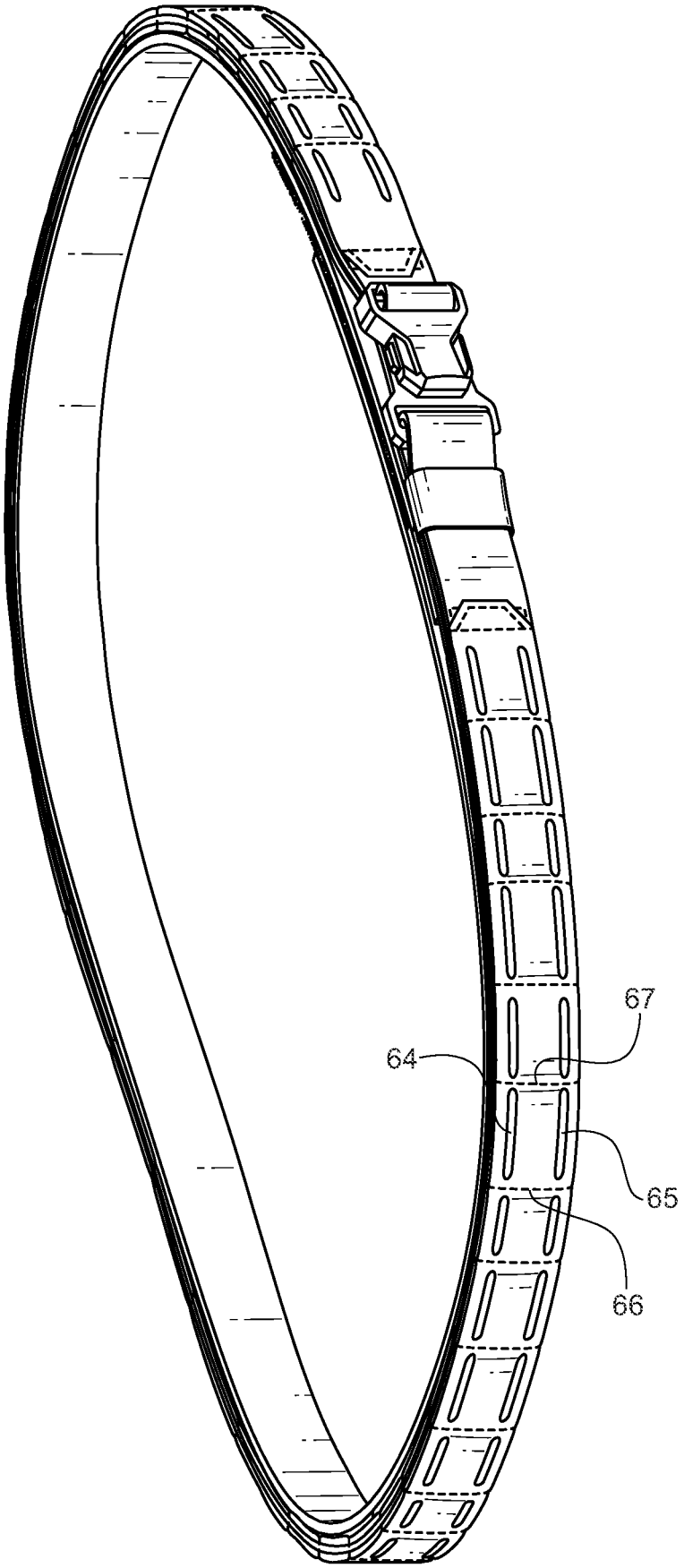
FIG. 3 is a perspective view of the present invention showing the inside belt mounted to the outside belt.

As seen in FIG. 3, the outer belt sections 63 can be defined between a first section stitch 66 and a second section stitch 67. The first section stitch is 66 and the second section stitch 67 pass through the first outer belt layer 61 and the second outer belt layer 62.

Figure 4:
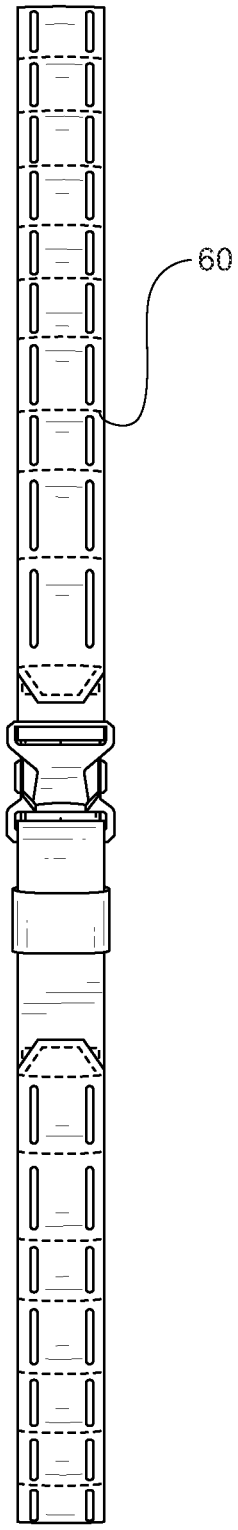
FIG. 4 is a side view of the outer belt.

As seen in FIG. 4, the outer belt 60 can be worn by itself individually.

Figure 5:
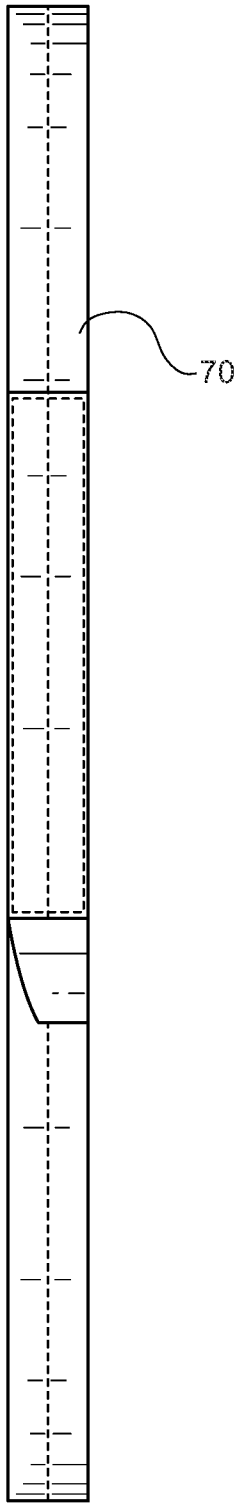
FIG. 5 is a side view of the inside belt.

As seen in FIG. 5, the inside belt 70 can also be worn individually.

Figure 6:
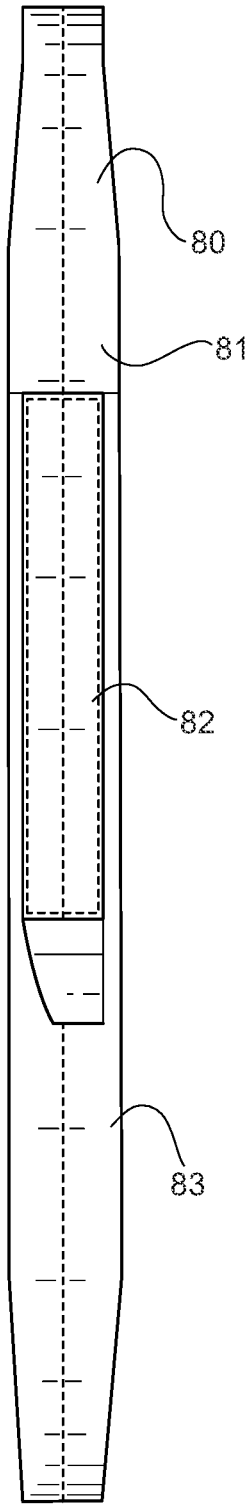
FIG. 6 is a side view of the padded belt.

As seen in FIG. 6, a padded belt 80 can have a belt pad 81 that is formed at a belt pad wider portion 83. The belt pad wider portion 83 of the padded belt 80 is wider than the inside belt 70. The padded belt 80 has a belt pad overlap 82 that can provide a connection for wearing.

Figure 7:
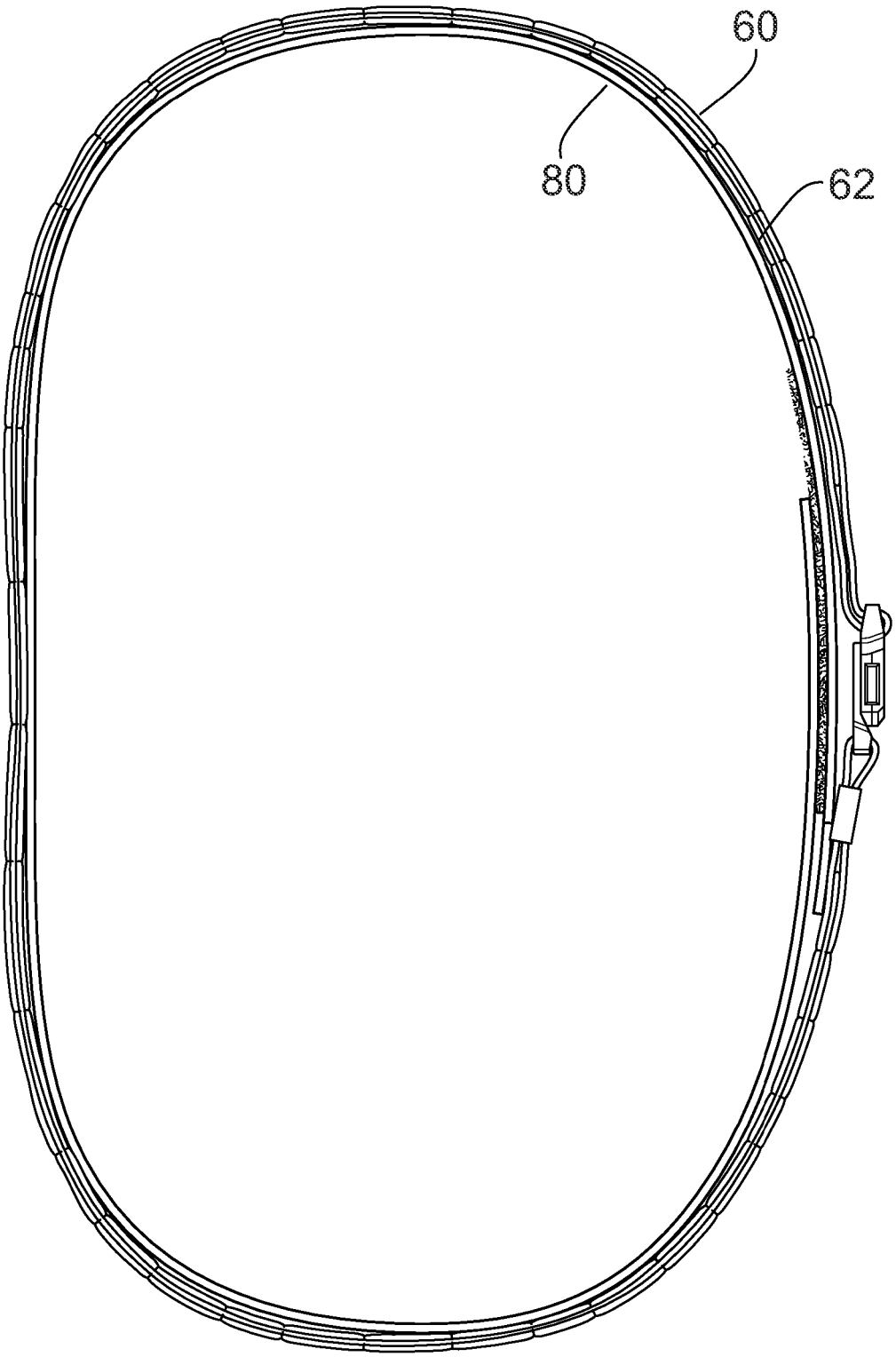
FIG. 7 is a top view of the outer belt with the padded belt mounted to the outer belt.

As seen in FIG. 7, the padded belt can be connected to the outside belt 60 at the second outer belt layer 62. The second outer belt layer 62 faces inwardly toward the user. Therefore, the modular system allows a quick connection and quick release of the belt while allowing modifications during use. A user can wear just the outer belt, just the inner belt, wear the outer belt with the inner belt, or wear the outer belt with the padded belt. When a user is wearing shorts or trousers, the user can use the inside belt. The user can also use the inside belt on the clothing and put the padded belt over the inside belt and then connect the outside belt to the padded belt. Thus, the modular configuration of the belts with the quick-change magnetic latch mechanism allows fast modular reconfiguration in the field.

Each of the MOLLE attachment points formed at the upper slots 64 and the lower slots 65 provides the user with different equipment configuration capabilities. The attachment points allow the user to change weight balance, accessibility and other utility parameters. When equipment reconfiguration shifts the weight around the user, the user can quick change the modular reconfiguration of the utility and tactical belt.

The invention claimed is:

1. A utility belt comprising:

a. an inside latch body, wherein the inside latch body includes an inside latch body loop;

b. an outside latch body, wherein the outside latch body is configured to release and connect to the inside latch body, wherein the outside latch body includes an outside latch body loop, wherein the outside latch body fits over the inside latch body;

c. an outside belt, wherein the outside belt connects to the inside latch body at the inside latch body loop, wherein the outside belt connects to the outside latch body at the outside latch body loop;

d. a main indent formed on the outside latch body;

e. a connecting stud formed on the inside latch body, wherein the connecting stud is configured to insert into the main indent;

f. a main indent magnet mounted at the main indent;

g. a connection stud magnet mounted in the connecting stud, wherein the connection stud attracts the main indent magnet which aligns the main indent to the connecting stud and biases the connecting stud into the main indent;

h. a main latch, wherein the main latch attracts to the connecting stud once the connecting stud inserts into the main indent i. a first release latch, wherein the first release latch extends into the main indent, and a second release latch, wherein the second release latch extends into the main indent, wherein the first release latch engages the connecting stud, wherein the second release latch engages the connecting stud; and j. side release buttons, wherein the side release buttons include a first button and a second button, wherein the first button is mounted opposite the second button, wherein the side release buttons are configured to release the first release latch and the second release latch.

2. The utility belt of claim 1, wherein the outside latch body further includes an inside housing and an outside housing.

3. The utility belt of claim 1, wherein the outside latch body has a main latch protrusion, wherein the inside latch body has a main latch depression, wherein the main latch depression is configured to receive the main latch protrusion, wherein the main latch is mounted within the main latch protrusion.

4. The utility belt of claim 1, wherein the connecting stud further includes a connecting stud front indent, wherein the main latch has a main latch engagement edge, wherein the main latch engagement edge is configured to engage the connecting stud front indent.

5. The utility belt of claim 1, wherein the first button is configured to release the second release latch, wherein the second button is configured to release the first release latch, wherein the second button is adjacent to the second release latch, wherein the first button is adjacent to the first release latch.

6. The utility belt of claim 1, further including a first side stud indent formed on the connecting stud and a second side stud indent formed on the connecting stud opposite the first side stud indent, wherein the first release latch engages the first side stud indent, wherein the second release latch engages the second side stud indent.

7. The utility belt of claim 1, wherein the outer belt includes further includes a substrate sandwiched between a first outer belt layer and a second outer belt layer, wherein the substrate is thicker and stiffer than the first outer belt layer and the second outer belt layer, wherein the first outer belt layer further includes outer belt sections, wherein the outer belt sections have upper slots and lower slots defined between first section stitches and second section stitches.

8. The utility belt of claim 7, wherein the utility belt further includes an inner belt, wherein the inner belt attaches to and removes from the outer belt.

9. The utility belt of claim 7, wherein the utility belt further includes a padded belt, wherein the padded belt attaches and removes from the outer belt, wherein the padded belt has a belt pad formed at a belt pad wider portion.

10. The utility belt of claim 7, wherein the utility belt further includes an inner belt, wherein the inner belt attaches to and removes from the outer belt, wherein the utility belt further includes a padded belt, wherein the padded belt attaches and removes from the outer belt, wherein the padded belt has a belt pad formed at a belt pad wider portion, wherein the inner belt is modularly interchangeable with the padded belt.

11. The utility belt of claim 10, wherein the outside latch body further includes an inside housing and an outside housing.

12. The utility belt of claim 10, wherein the outside latch body has a main latch protrusion, wherein the inside latch body has a main latch depression, wherein the main latch depression is configured to receive the main latch protrusion, wherein the main latch is mounted within the main latch protrusion.

13. The utility belt of claim 10, wherein the connecting stud further includes a connecting stud front indent, wherein the main latch has a main latch engagement edge, wherein the main latch engagement edge is configured to engage the connecting stud front indent.

14. The utility belt of claim 10, wherein the first button is configured to release the second release latch, wherein the second button is configured to release the first release latch, wherein the second button is adjacent to the second release latch, wherein the first button is adjacent to the first release latch.

15. The utility belt of claim 10, further including a first side stud indent formed on the connecting stud and a second side stud indent formed on the connecting stud opposite the first side stud indent, wherein the first release latch engages the first side stud indent, wherein the second release latch engages the second side stud indent.

16. The utility belt of claim 10, wherein the outer belt includes further includes a substrate sandwiched between a first outer belt layer and a second outer belt layer, wherein the substrate is thicker and stiffer than the first outer belt layer and the second outer belt layer, wherein the first outer belt layer further includes outer belt sections, wherein the outer belt sections have upper slots and lower slots defined between first section stitches and second section stitches.

* * * * *